US006326532B1

(12) United States Patent
Antaki

(10) Patent No.: US 6,326,532 B1
(45) Date of Patent: Dec. 4, 2001

(54) HARMONICA HAVING REED VIBRATION CONVERSION CAPABILITY AND ASSOCIATED RETROFITTING METHOD

(76) Inventor: James F. Antaki, 4373 Mount Royal Blvd., Pgh, PA (US) 15101

( * ) Notice: Subject to any disclaimer, the term of this patent is extended or adjusted under 35 U.S.C. 154(b) by 0 days.

(21) Appl. No.: 09/452,707

(22) Filed: Dec. 2, 1999

(51) Int. Cl.[7] ..... G10D 7/12
(52) U.S. Cl. ..... 84/377
(58) Field of Search ..... 84/377, 378, 379

(56) References Cited

U.S. PATENT DOCUMENTS

| | | | | |
|---|---|---|---|---|
| 2,407,312 | * | 9/1946 | Magnus | 84/377 |
| 2,592,220 | * | 4/1952 | Wetzler | 84/377 |
| 2,595,316 | * | 7/1952 | Wetzler | 84/377 |
| 3,580,125 | | 5/1971 | Heatwole . | |
| 4,196,650 | * | 4/1980 | Fricke et al. | 84/1.1 |
| 4,619,175 | | 10/1986 | Matsuzaki . | |
| 4,984,499 | | 1/1991 | Schille et al. . | |
| 5,245,130 | * | 9/1993 | Wheaton | 84/742 |
| 5,367,937 | * | 11/1994 | Epping | 84/377 |
| 5,377,574 | * | 1/1995 | Lempe | 84/377 |

FOREIGN PATENT DOCUMENTS 4328600 11/1992 (JP) .

* cited by examiner

*Primary Examiner*—Robert E. Nappi
*Assistant Examiner*—Kim Lockett
(74) *Attorney, Agent, or Firm*—David V. Radack; Eckert Seamans Cherin & Mellott, LLC

(57) ABSTRACT

An improved harmonica is disclosed that includes a plurality of reeds and means operatively associated with at least one of the reeds that converts the mechanical vibration of the reed into electrical energy. The electrical signals are obtained and processed by a sensor board having sensors positioned thereon that correspond to the plurality of reeds on the reed plates of the harmonica. A variety of types and configurations for these sensors are provided. In addition, a piezoelectric material can be employed in conjunction with the reeds to alter the characteristics of their mechanical vibration during harmonica play. The sensor board or boards of the harmonica can be electrically coupled to auxiliary signal conditioning equipment, such as stereo equipment or conventional amplification equipment to further enhance play. Methods for retrofitting a commercially available harmonica with at least one sensor board are also provided.

15 Claims, 14 Drawing Sheets

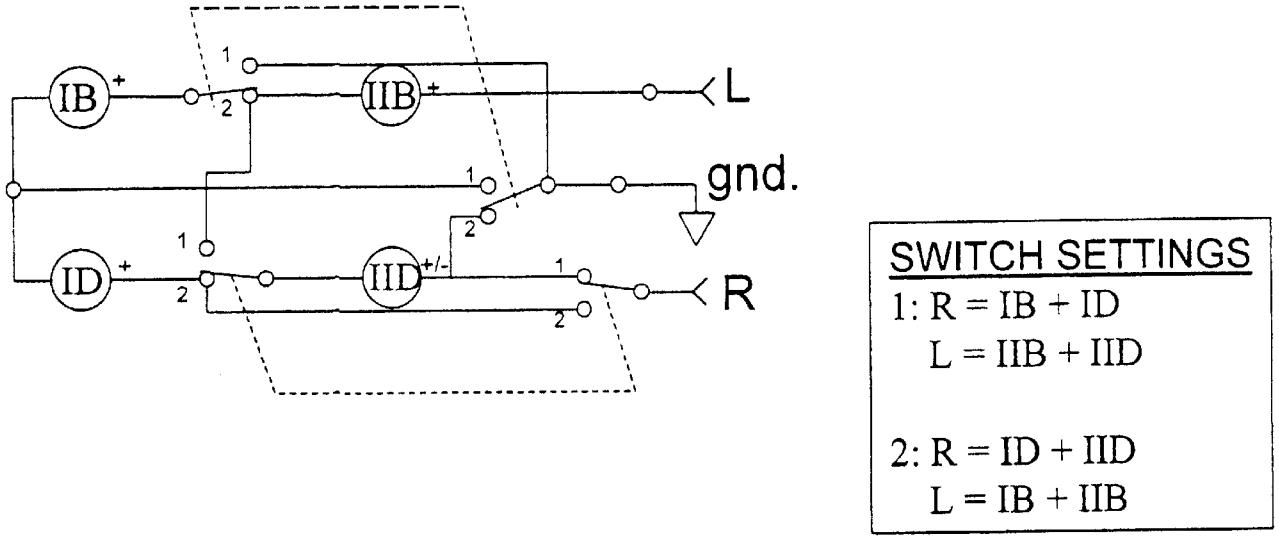
Fig 14a
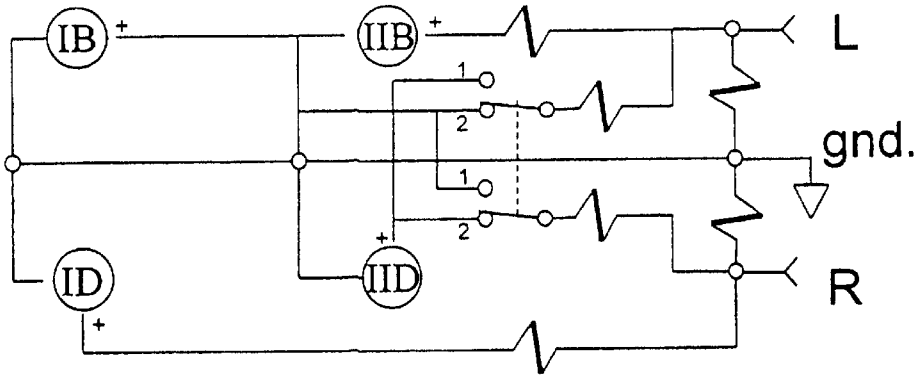
Fig 14b
Fig 14

HARMONICA HAVING REED VIBRATION CONVERSION CAPABILITY AND ASSOCIATED RETROFITTING METHOD

BACKGROUND OF THE INVENTION

1. Field of the Invention

The present invention relates to an improved harmonica and more specifically to a harmonica having means operatively associated with the reeds of the harmonica that converts the mechanical vibration of harmonica reeds into electrical energy.

2. Background Information

Harmonicas are among the world's oldest musical instruments. Harmonicas produce musical tones by a player blowing or drawing air into the harmonica to vibrate one or more of the reeds of the harmonica.

The means of projecting sound to an audience by harmonica is typically performed by direct acoustic means. That is, the air pressure produced by the player blowing or drawing air through the harmonica is transmitted to the audience as an acoustical wave of sound. If amplification means are desired to reinforce this sound, a microphone is typically used in conjunction with the harmonica. The microphone is placed either adjacent to the musician, or cupped in the musician's hands in close proximity with the harmonica. The sound generated by any individual reed of the harmonica is mixed with sound produced by all other active reeds. This therefore limits the isolation of individual sounds, or notes, produced from the discrete reeds.

A problem with conventional means of amplification is the tendency of spurious sounds to enter the microphone, such as the air flow caused by the player's breath, or amplified sound emanating from a nearby speaker, for example, that can produce undesirable feedback noise. In the context of stringed instruments, there have been suggested electronic means for obviating these problems by more directly converting the mechanical movement of the string to an electrical voltage. The voltage, in turn, is transmitted to an amplifier or recording device to produce audible sound. However, no such means have been taught or suggested for similar application to a harmonica.

There have been suggested electronic harmonicas that control electronic sound synthesizing devices. See, e.g., U.S. Pat. No. 4,984,499. This patent teaches replacement of the reeds in a conventional harmonica with airflow sensors comprised of electrical strain gages on an elastic member. Flexing of the elastic member by the flow and direction of air drawn or blown into the harmonica is stated to cause a detectable change of resistance. This change of resistance is fed into a synthesizer that reproduces a musical note. It will be appreciated that this "harmonica" differs from a traditional harmonica that includes vibrating reeds and therefore does not provide the dynamic expression that is associated with the diatonic harmonica. See also, e.g., U.S. Pat. No. 4,619,175.

What is needed, however, are an apparatus and associated method including a harmonica having conventional reeds that can convert mechanical reed vibrations into electrical signals that can be amplified, mixed and otherwise manipulated. What is also needed is an improved harmonica that is inexpensive to manufacture. In addition, a retrofitting method is needed that can provide a traditional diatonic harmonica with the benefits of electrical conversion of mechanical reed vibrations into electrical signals representative of the mechanical vibrations.

SUMMARY OF THE INVENTION

The improved harmonica and associated method of the present invention have met and/or exceeded the above-mentioned needs, as well as others. The improved harmonica includes means operatively associated with at least one of the reeds of the harmonica that converts the mechanical vibration of the reed into electrical energy. The present invention can also include a sensor board having sensors thereon that are adapted to be placed adjacent to at least one of a plurality of reeds of a harmonica. The sensor board converts the mechanical vibration of the reed or reeds into an electrical signal or signals that are representative of that reed or reeds. The present invention also provides a method for retrofitting a conventional harmonica with a sensor board to impart the harmonica with the benefits of the improved harmonica of the present invention.

Therefore, it is an object of this invention to provide an improved harmonica wherein mechanical vibrations of its reeds are transformed to electrical signals.

It is an additional object of the present invention to provide a harmonica that incorporates electrical sensors for converting the mechanical motion of its reeds to electrical energy.

It is an additional object of the present invention to provide an apparatus that can be applied to a diatonic harmonica to enhance the function of the harmonica.

It is an additional object of this invention is to provide a method for retrofitting an existing acoustic harmonica to provide for the conversion of mechanical reed vibrations into electrical signals.

It is an additional object of this invention to provide an improved harmonica that allows a broader range of effects than can be obtained acoustically or with an external microphone.

These and other objects of the present invention will be more fully understood from the following description of the invention and by reference to the figures and claims appended hereto.

BRIEF DESCRIPTION OF THE DRAWINGS

A full understanding of the invention can be gained from the following detailed description of the invention when read in conjunction with the accompanying drawings in which:

FIGS. 14A and 14B are partially schematic circuit diagrams showing electrical connection embodiments for the sensors of FIG. 13; and, FIG. 15 is an exploded, isometric view showing an embodiment of the retrofitting method of the present invention.

DESCRIPTION OF THE PREFERRED EMBODIMENT

Figure 1:
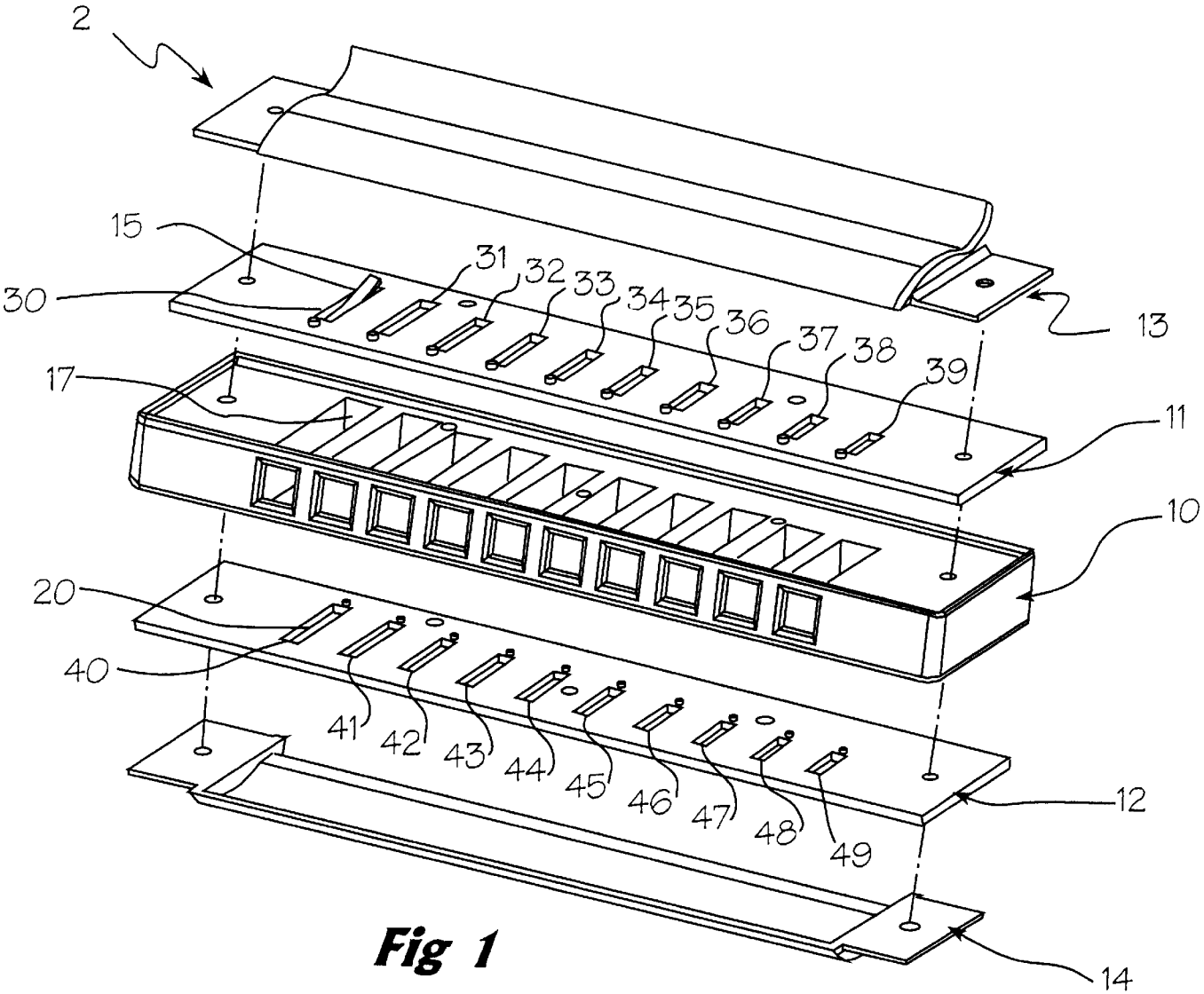
FIG. 1 is an exploded, isometric view of an embodiment of a harmonica.
Figure 2:
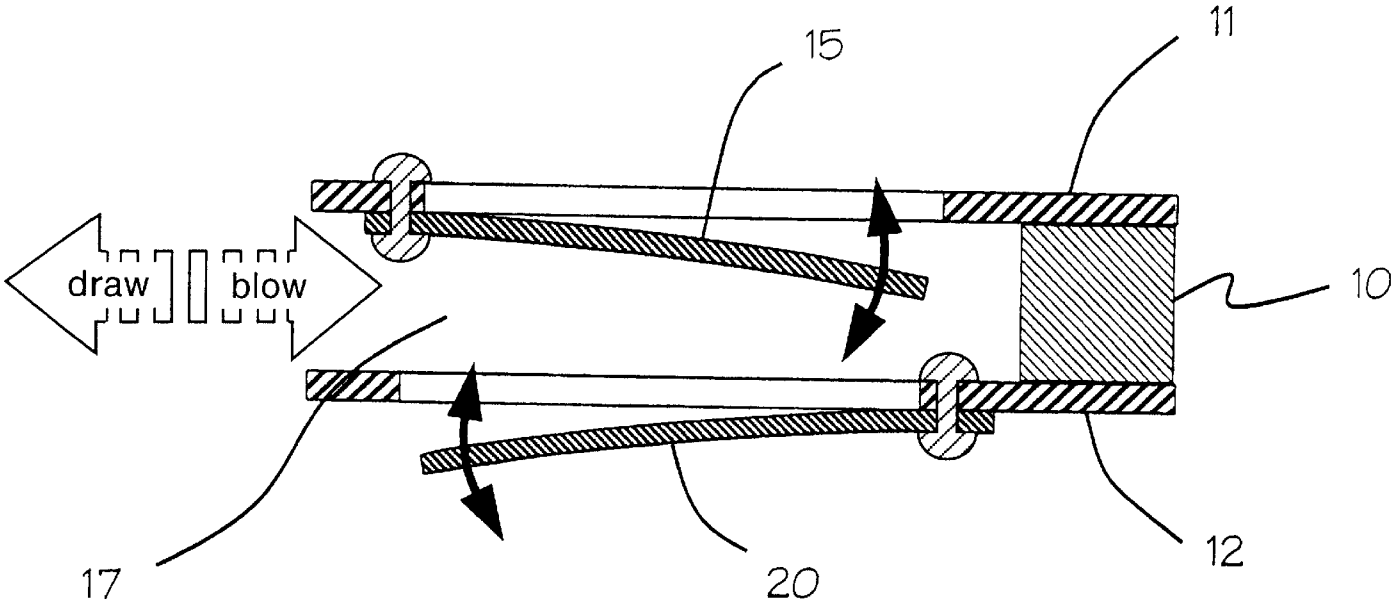
FIG. 2 is a sectional, partially schematic view depicting a pair of reeds in a harmonica.

Referring now to FIGS. 1 and 2, a diatonic harmonica 2 is shown including a body or "comb" depicted generally at 10. The comb 10 is preferably fabricated of a wood, resinous plastic or metal material. The comb 10 is sandwiched between two plates 11,12 which include a blow reed plate shown generally at 11 and a draw reed plate shown generally at 12. The plates 11,12 are further sandwiched within a housing comprising an upper cover 13 and a mating lower cover 14. The plates 11,12 are preferably composed of brass or another material suitable for use in a harmonica. It can be appreciated that the harmonica 2, with positions for assembly, can be secured by conventional mechanical fasteners such as screws, bolts and the like.

As shown in FIG. 1, the blow reed plate 11 contains a plurality of blow reed slots, 30–39, each accommodating a blow reed such as reed 15 (shown slightly flexed) in each blow reed slot such as slot 30. The blow reeds 15 are mounted on the blow reed plate 11 such that when the blow reed plate 11 is positioned next to the comb 10 during assembly, the blow reeds 15 seat inside the grooves 17 contained in the comb 10. These grooves 17 allow air passage into and out of the harmonica 2 by the actions of blowing and drawing, respectively. The draw reed plate 12 has within it a series of draw reed slots, 40–49, each including a draw reed 20 therein. The draw reeds 20 are mounted on the outside of the draw reed plate 12 relative to the comb 10. The draw reeds 20 naturally vibrate when the harmonica player draws air out of the harmonica. Each blow reed 15, such as the blow reed 15 in position 30, has a corresponding draw reed 20, such as the draw reed 20 in position 40, positioned directly opposite the blow reed 15, such that the matched pair of reeds 15,20 share a common groove 17. During harmonica play, each groove 17 communicates with a blow reed 15 and a draw reed 20 as a matched pair of reeds 15, 20.

Referring again to FIGS. 1 and 2, the draw reeds 20 in positions 40–49 normally sound only when air is drawn out of the harmonica 2. This is how the diatonic harmonica 2 is designed to operate during normal play. However, it has been established that during certain procedures, known as "bends," "overblows," and "overdraws," wherein the resonance of the vocal tract is critically altered, both the draw reeds 20 and the blow reeds 15 can be caused to vibrate sympathetically.

Figure 3:
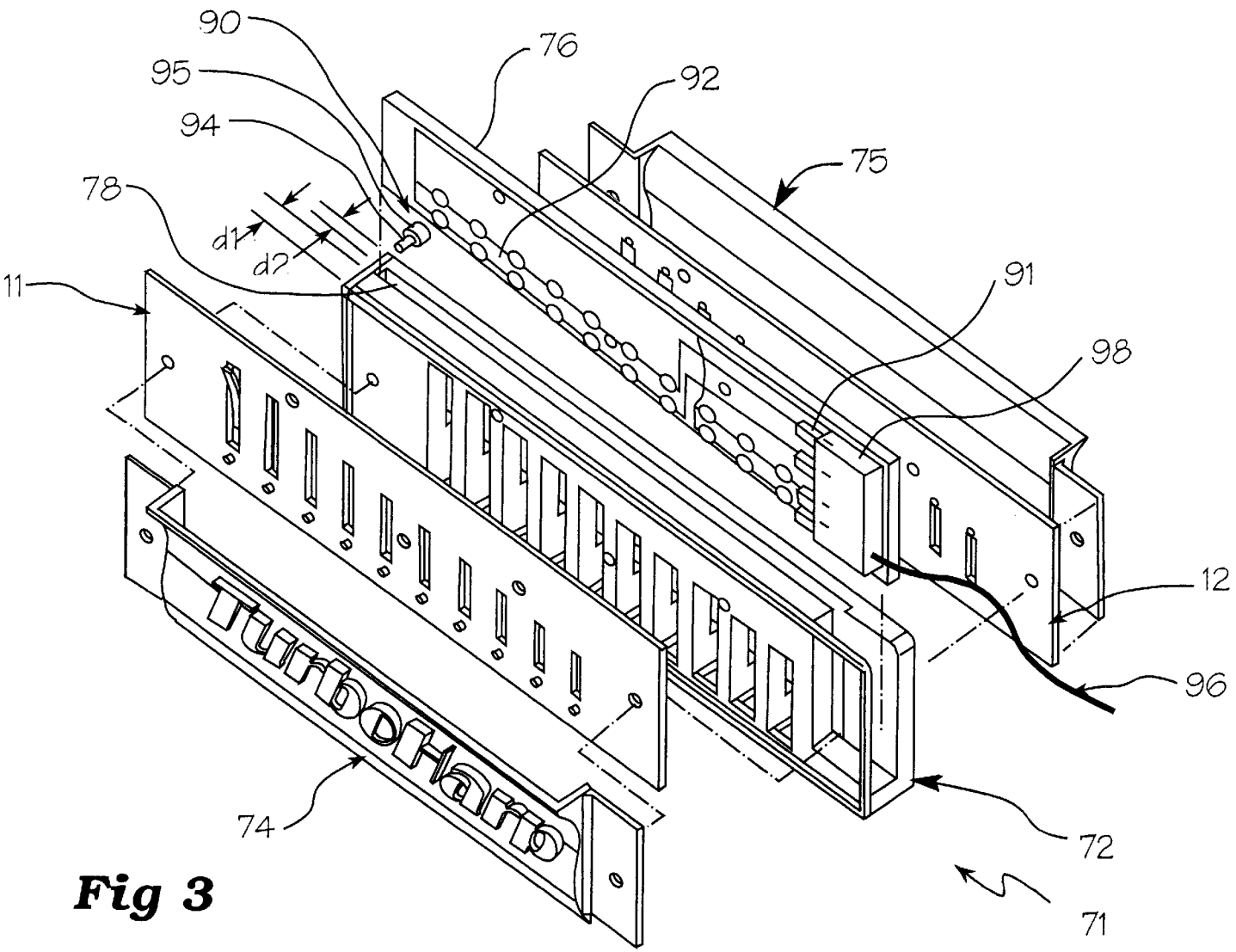
FIG. 3 is an exploded, isometric view of an embodiment of the improved harmonica of the present invention.

Referring now to FIGS. 1 through 3, in the form shown, the harmonica 71 of the present invention can include several principal elements. First, the acoustical energy generating source of the harmonica is a standard set of reed plates 11, 12 having reeds 15,20 attached in positions 30–39 and 40–49 to a central comb 72 that allows air to be channeled from the mouth of the player (not shown) to the individual reeds 15,20 in positions 30–39 and 40–49. A set of cover plates 74,75 serve to house and protect the reeds 30–39 and 40–49, altering the acoustics of the harmonica 71 and thereby also altering the timbre of sound produced during harmonica play. A sensor board 76, in a preferred embodiment, is positioned within the comb 72 of the harmonica 71 by means of a transverse slot 78 formed along an axis of the comb 72. The transverse slot 78 can be formed within the comb 72 so as to maintain an upper distance $d_1$between the sensor board 72 and the upper reed plate 11 and a lower distance $d_2$ between the sensor board 76 and the lower reed plate 12. The upper and lower distances $d_1$,$d_2$ are preferably not equal. It can be understood that these distances $d_1$,$d_2$ are selected so that the sensor board 76 is positioned in the comb 72 substantially equidistant between matching blow reeds 15 and draw reeds 20.

Referring again to FIGS. 1 through 3, the reeds 15, 20 of the harmonica 71 can be attached to the reed plates 11,12 by a rivet or another suitable mechanical fastener such as a spot weld, a screw, adhesive and the like. The sensor probes such as sensor probe 90 include a coil 94 positioned substantially within a sensor iron 95. The sensor probes are positioned on the sensor board 76 so that when the sensor board 76 is inserted into the transverse slot 78 during assembly, at least one sensor probe 90 is in substantial alignment with a matched pair of reeds such as the reeds 15,20 to detect mechanical vibrations propagated by these reeds 15, 20 during harmonica play. Electrical conductors such as conductor 92 provide electrical coupling to the sensor electronics to carry electrical signals to and from the sensor probe 90.

Referring again to FIGS. 1 through 3, the reeds in positions 30–39 and 40–49 are preferably composed of a conductive or ferromagnetic metal and can influence the inductance of a coil such as the coil 94 of the sensor probe 90. When a reed in positions 30–39 and/or 40–49 vibrates for a time period, there is a corresponding time variation in the inductance of the coil 94. It can be appreciated that this time-varying coil inductance can be converted into an electrical signal by suitable apparatus and methods known to those skilled in the art. For example, the inductance or eddy current sensor electronics marketed and sold under the "Kaman SMU-9200" trade designation can be utilized to perform this conversion of the time-varying coil inductance into an electrical signal. It can also be appreciated that sound conditioning equipment such as transducers, signal conditioners, filters, mixers, and the like can be used with the sensor board 76 during harmonica play.

Referring more particularly to FIG. 3, in another aspect of the present invention, a wire 96 is electrically coupled to and extends from the sensor board 76 of the harmonica 71, such as where the sensor board 76 and a connector 98 form a junction. The wire 96 can be plugged directly into standard audio recording or broadcasting equipment, for example. It will be appreciated by those skilled in the art that different sensor boards performing different functions can be provided for use in the harmonica 71. The provision of an assortment of differently functioning sensor boards such as sensor board 76 provides for a myriad of possible audio effects.

Referring again to FIG. 3, the electrical leads 92 extending from the sensor probe 90 can be connected in series with a capacitor 91, thereby creating an electrically resonant circuit. The sensor 90 and capacitor 91 are then connected to a conventional signal conditioning circuit by the means previously discussed and described in FIG. 3. The signal conditioning circuit converts the resonance of the sensor-capacitor circuit into an electrical signal suitable, for example, for existing sound recording or amplification equipment. It is therefore appreciated by those skilled in the art that use of circuitry, including capacitors, for example, can acceptably substitute for a direct connection to an amplifier, for example, or another suitable sound conditioning piece of equipment.

Figure 4:
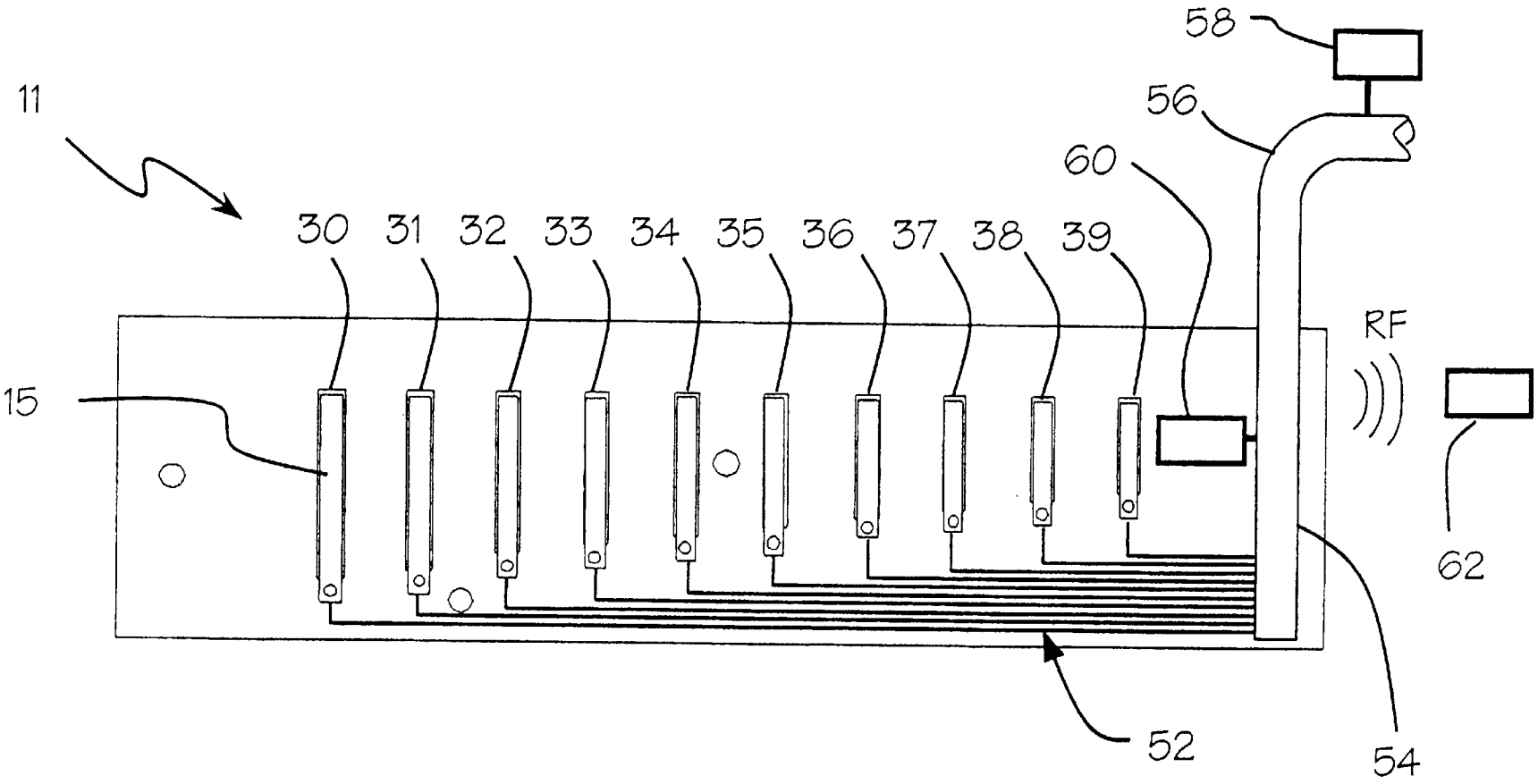
FIG. 4 is a schematic view of a reed plate employed in the present invention.

Referring now to FIG. 4, in another aspect of the present invention, an electrical conductor such as conductor 52 is associated with each blow reed 15 for receiving electric signals which are produced when the blow reed 15 is vibrated by the movement of air through the harmonica. It can be understood that the conductors 52 can be formed on the blow reed plate 11 in a manner similar to a conventional printed electric circuit board. In the embodiment of the present invention shown in FIG. 4, the conductors 52 are connected to a terminal 54 which in turn is connected to a shielded cable 56, exaggerated in size for purposes of illustration, that conducts the electrical signals to an auxiliary electrical signal treatment apparatus 58 such as a mixer board, receiver or recording device.

In another embodiment shown in FIG. 4, a radio transmitter 60 can be used that is electrically coupled to the conductors and that generates radio frequency waves RF based on the electrical signals received from the reeds. The radio frequency waves RF can be received by a receiver 62 for broadcast or other manipulation of the radio frequency waves RF. From the receiver 62, the waves RF can be transferred to a speaker, a recording device, another broadcast transmitter (repeater) among other suitable sound conditioning components.

In accordance with the present invention, the transduced electrical signals can be amplified, modified or otherwise altered to produce unique signals. For example, the low notes can be connected to circuitry that provides a sustained effect, while the high notes are given a distorted effect. Alternatively, the blow notes, also known as "third intervals" can be routed to the left channel and the draw notes to the right channel of a conventional piece of recording or broadcast equipment. As another example, electrical signals obtained from the mechanical vibration of the reeds could be used to stimulate synthesized notes, sounds or chords processed in a remote signal-conditioning unit.

It can be appreciated that, as the reeds continue to vibrate, albeit transiently, once the airflow has ceased, the electrical signals corresponding to the reed vibrations also continue transiently. The present invention provides for amplification of the electrical signals so that a decaying, oscillatory sound effect can be created. Furthermore, while performing a bent, overdrawn or overblown note, it is known that the action of the reed is inherently transferred from blow-to-draw reed or from draw-to-blow reed. In accordance with the present invention, the illusion of movement can be achieved by connecting each of the upper and lower sets of reeds to different channels on a piece of conventional sound conditioning equipment.

Within the scope of the present invention, a variety of types of sensors can be used which may include sensors selected from the group consisting of resistive, piezoelectric, piezoresistive, magnetoresistive, capacitive, induction, inductance (eddy-current), and optical types. In a preferred embodiment, the sensors are designed and structured in the form of an electromagnetic pickup.

Figure 5:
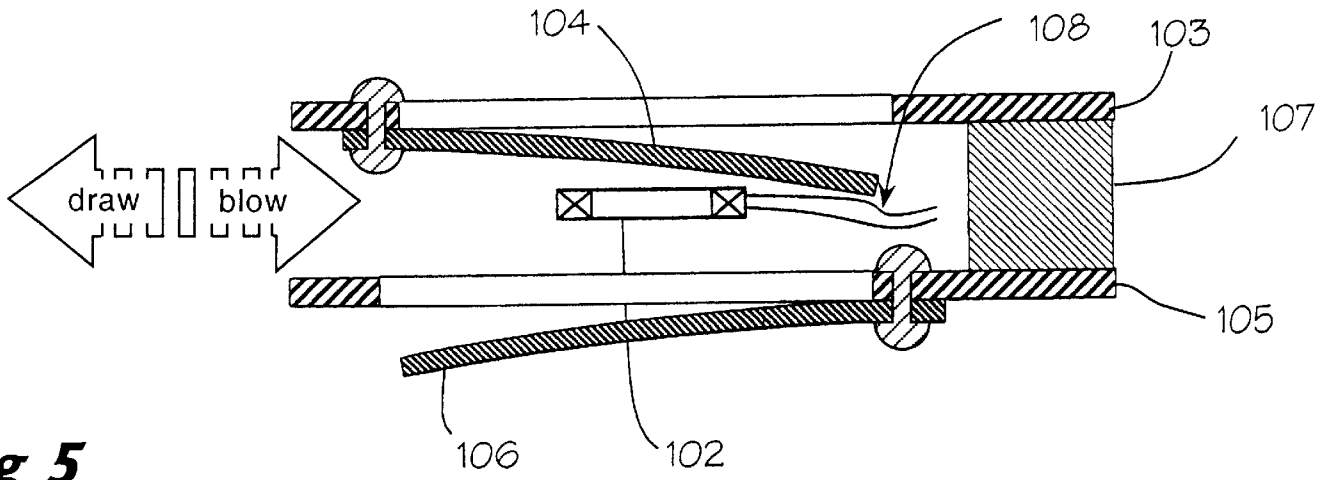
FIG. 5 is a sectional, partially schematic view depicting an electromagnetic sensor embodiment of the present invention.
Figure 6:
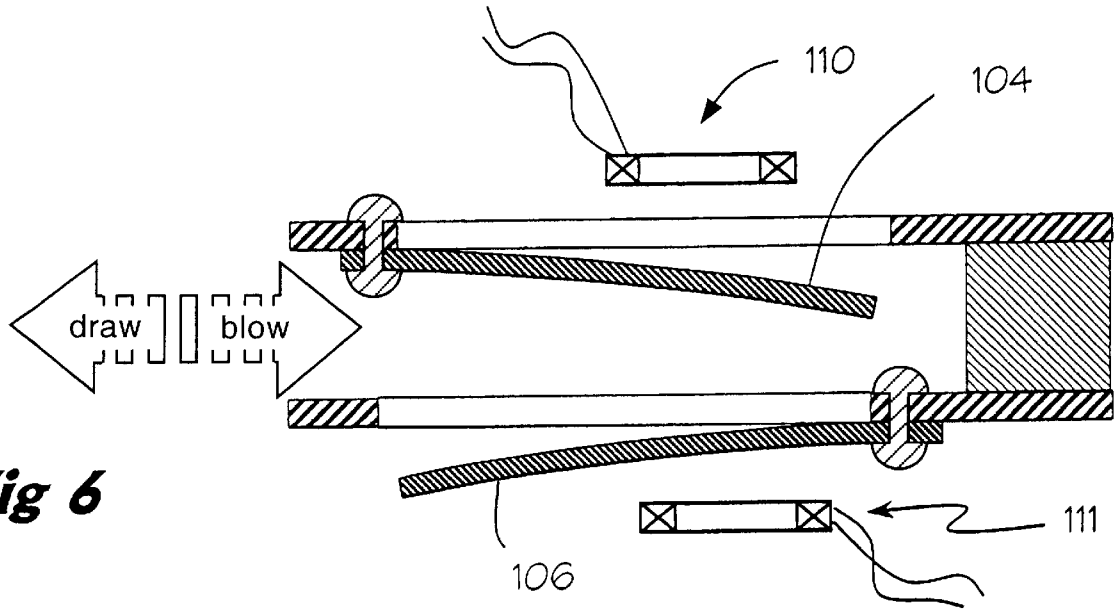
FIG. 6 is a sectional, partially schematic view depicting an electromagnetic sensor embodiment of the present invention.

Referring now to FIGS. 5 and 6, a plurality of sensor probes, such as sensor probe 102, can be positioned on a sensor board (not shown) adjacent to a reed position of a comb 107. The sensor probe 102 is situated in substantial alignment with a matching pair of corresponding reeds such as reeds 104, 106 that are connected to the reed plates 103, 105. Preferably, at least one such sensor probe 102 is positioned generally adjacent to each reed such as reeds 104,106. The sensor probe 102 operates in conjunction with its corresponding reeds 104,106 to convert the mechanical vibrations of the reeds 104,106 into an electrical signal or signals representative of those mechanical vibrations that occur during harmonica play. It can be appreciated that the characteristics of these converted electrical signals are a function of the flexibility and other general physical properties of the reeds 104,106. Electrical conductors such as the electrical leads 108 direct current from the sensor probe 102 to auxiliary sound conditioning equipment, for example, attached to the sensor probe 102.

With particular reference to FIG. 6, more than one sensor probe can be provided so that a first sensor probe 110 is positioned generally adjacent to a given blow reed 104 to receive and process vibrations received from the blow reed 104 during harmonica play. Similarly, a second sensor probe 111 is positioned generally adjacent to a given draw reed 106 to receive and process vibrations from the draw reed 106 during harmonica play. In this aspect of the present invention, greater flexibility is afforded for obtaining and manipulating electrical signals with sound conditioning equipment during harmonica play.

Figure 7:
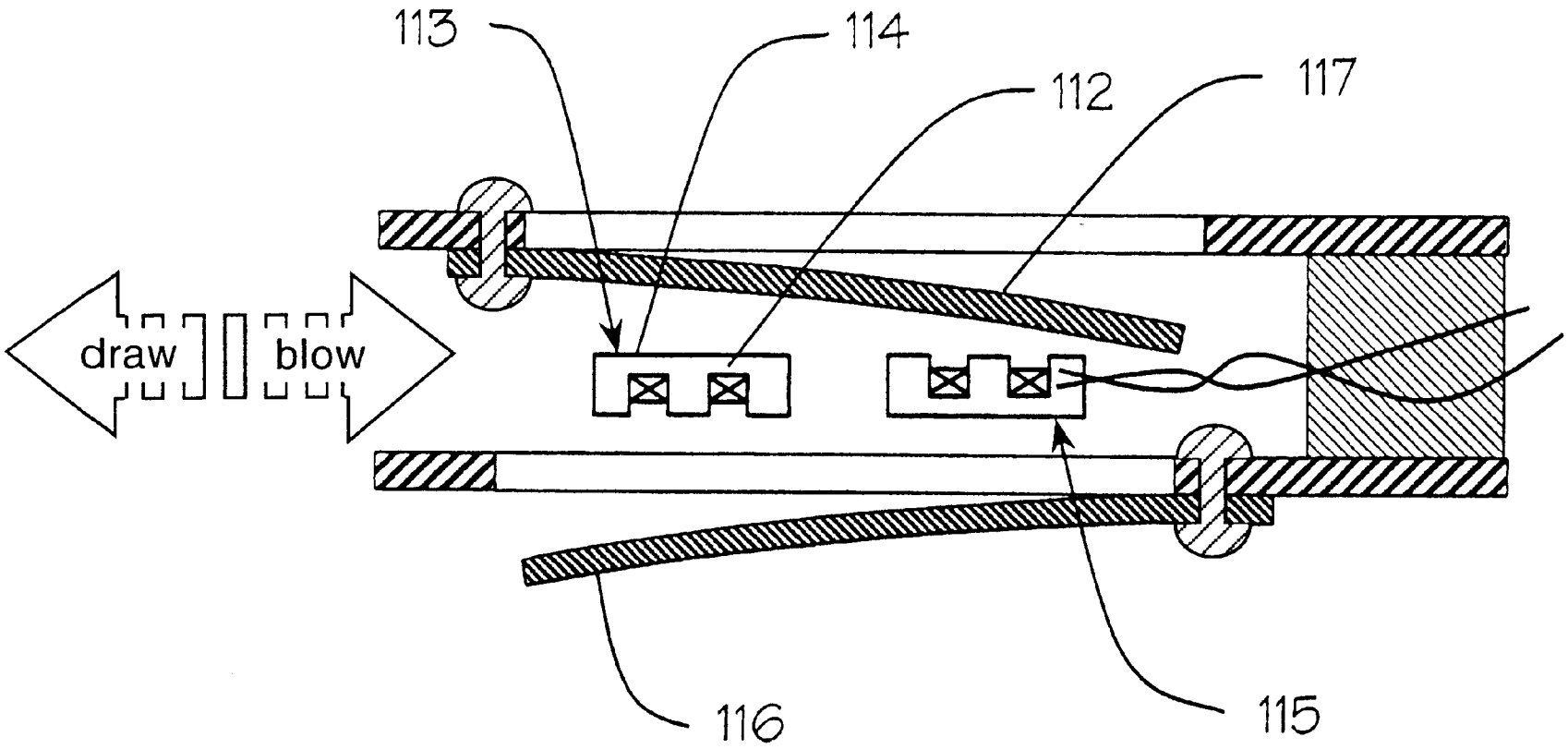
FIG. 7 is a sectional, partially schematic view depicting an electromagnetic sensor embodiment of the present invention.

Referring now to FIG. 7, in another aspect of the present invention, the sensor probes previously described and depicted in FIGS. 5 and 6 can be replaced with sensor probes 113, 115 that each have a shielded coil 112 that has a cup-core type rite shield 114 that tends to focus the magnetic field produced, for example, by the coil 112 toward the reed 116. In this embodiment, each sensor is positioned in focused, substantial alignment to sense a corresponding reed of the harmonica. Therefore, at least two such sensors are employed per set of matching reeds in this embodiment.

Figure 8:
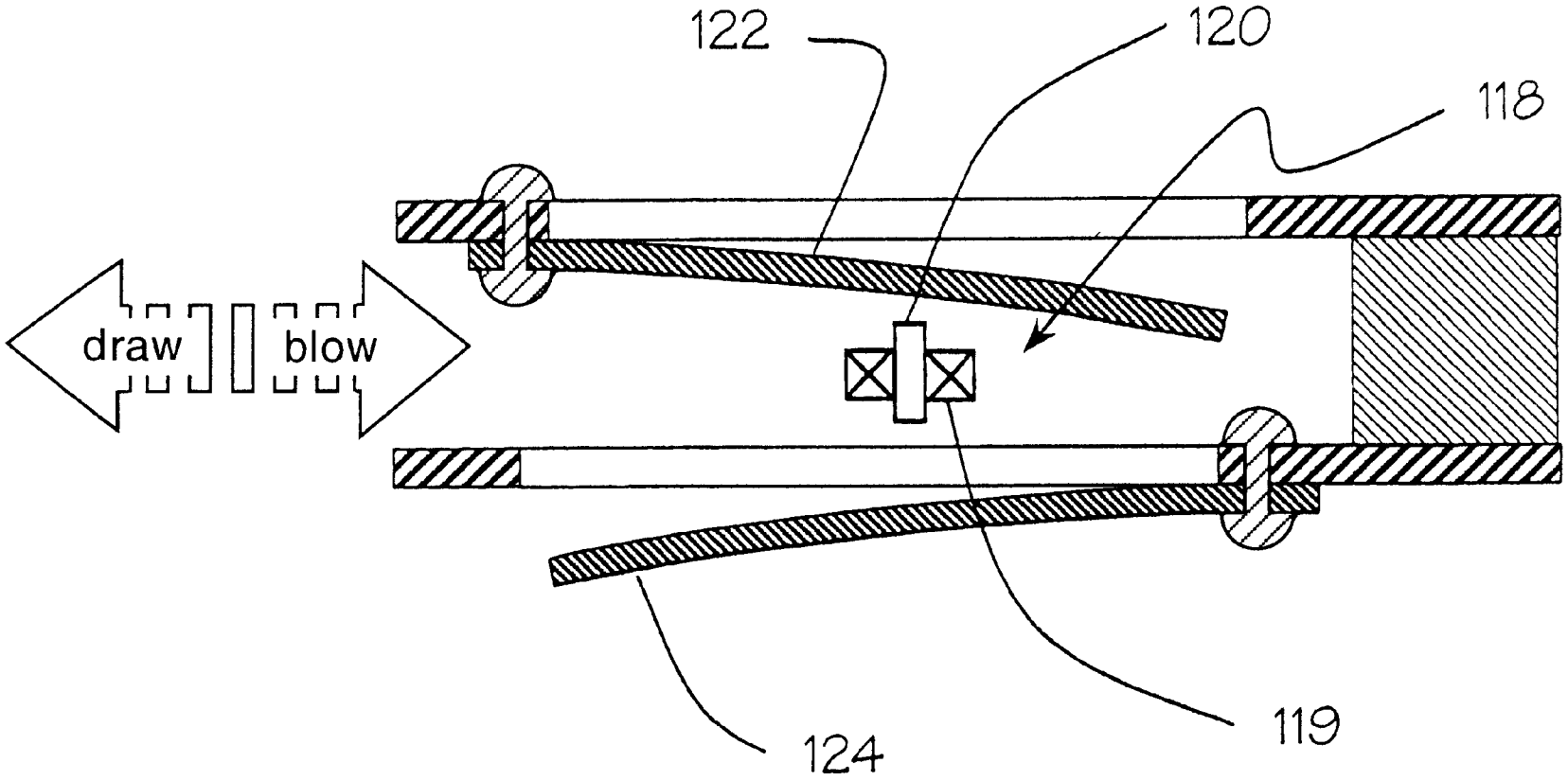
FIG. 8 is a sectional, partially schematic view depicting an electromagnetic sensor embodiment of the present invention.

Referring now to FIG. 8, in another aspect of the present invention, a single sensor 118 including an insulated coil 119 wound on a ferromagnetic pole 120 is positioned between the two reeds 122,124 to provide bi-directional sensing. That is, the sensor coil 119 of the sensor 118 acts as a transducer to convert the mechanical vibrations of both upper and lower reeds, 122 and 124 respectively, in the matching set of reeds 122,124, into electrical energy. The sensor coil 119 of this aspect of the present invention can be encased in conductive wire, etched onto a printed circuit board, or provided in another suitable manner consistent with the scope of the present invention.

Referring again to FIGS. 4 through 8, it can be appreciated that the coils shown in these figures can be used in conjunction with ferromagnetic and/or conductive harmonica reeds. In this aspect of the present invention, the motion of a reed relative to a sensor alters the magnetic flux through the sensor and thereby alters the inductance of the sensor. Electrical circuitry, such as a bridge circuit or resonator and frequency-to-voltage converter connected to the coil, can then be utilized to detect this change of inductance. This can be considered an inductance or eddy-current sensor embodiment of the present invention.

Referring again to FIGS. 4 through 8, the core, such as core 114 in FIG. 7 or the core 120 in FIG. 8, for example, can be replaced by a suitable magnet. In this aspect of the present invention, the motion of a given reed causes a voltage to be induced in the coil. A significant benefit of this magnet substitution is that the coil can then be connected directly to an amplifier or other similar piece of sound conditioning equipment without the need for excessive electrical circuitry. This can be considered an induction sensor embodiment of the present invention. It can be understood by those skilled in the art that the reed or reeds can also be magnetized, thereby alleviating the need to replace the core with a magnet.

Figure 9:
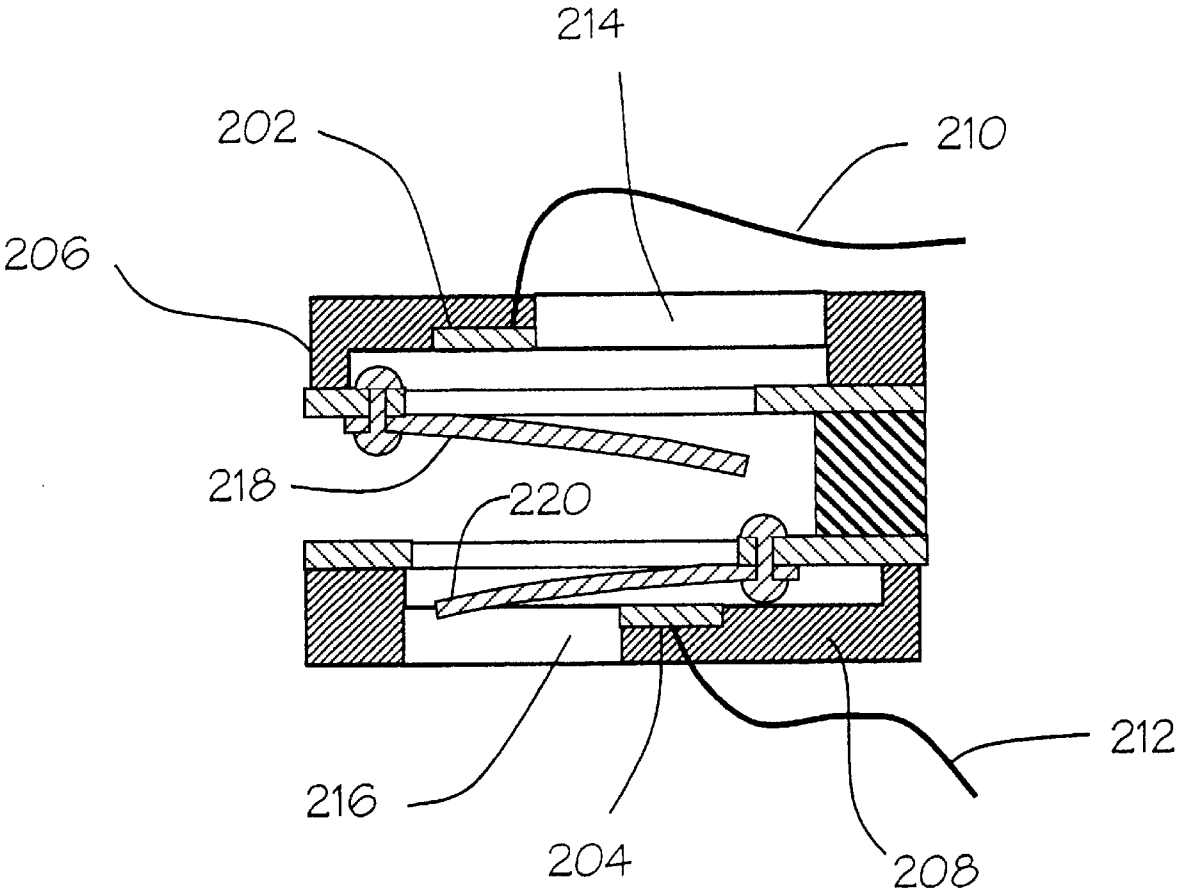
FIG. 9 is a sectional, partially schematic view depicting an electromagnetic sensor embodiment of the present invention.

Referring now to FIG. 9, it can also be appreciated that a capacitive sensor or probe can also be used in the present invention. This aspect of the present invention lends itself to reduced manufacturing costs, since capacitive sensors typically employ existing printed circuit board manufacturing technology. In operation of the capacitive sensor during harmonica play, the capacitance of the sensor varies with the motion of its corresponding reed when the reed is connected to an electrical circuit. The capacitive sensor can be electrically coupled to auxiliary sound conditioning equipment. With respect to the function of the capacitive sensor, the conversion of a time-varying capacitance to a time-varying voltage is generally known in the art. See, e.g., *Handbook of Modern Sensors,* Springer Verlag, N.Y., 1996.

In the capacitive sensor form of the present invention shown in FIG. 9, the sensor arrangement includes sensors or electrodes 202, 204 embedded within insulators 206, 208, respectively. Electrical conductors such as wires 210, 212 are connected, respectively, to the electrodes 202, 204. Air channels 214, 216 are formed, respectively, in the insulators 206, 208 as shown. The wires 210, 212 carry electrical signals from the electrodes 202, 204 and are preferably connected to a sound conditioning circuit or piece of equipment such as an amplifier (not shown), for example. The insulators 206, 208 are preferably composed of a suitable electrically insulative material such as wood, resinous plastic and the like. It can be appreciated that the electrodes are positioned to receive and transduce mechanical vibrations of harmonica reeds 218, 220 during play to convert those mechanical vibrations into an electrical signal or signals that are further processed in accordance with previously discussed aspects of the present invention.

Figure 10:
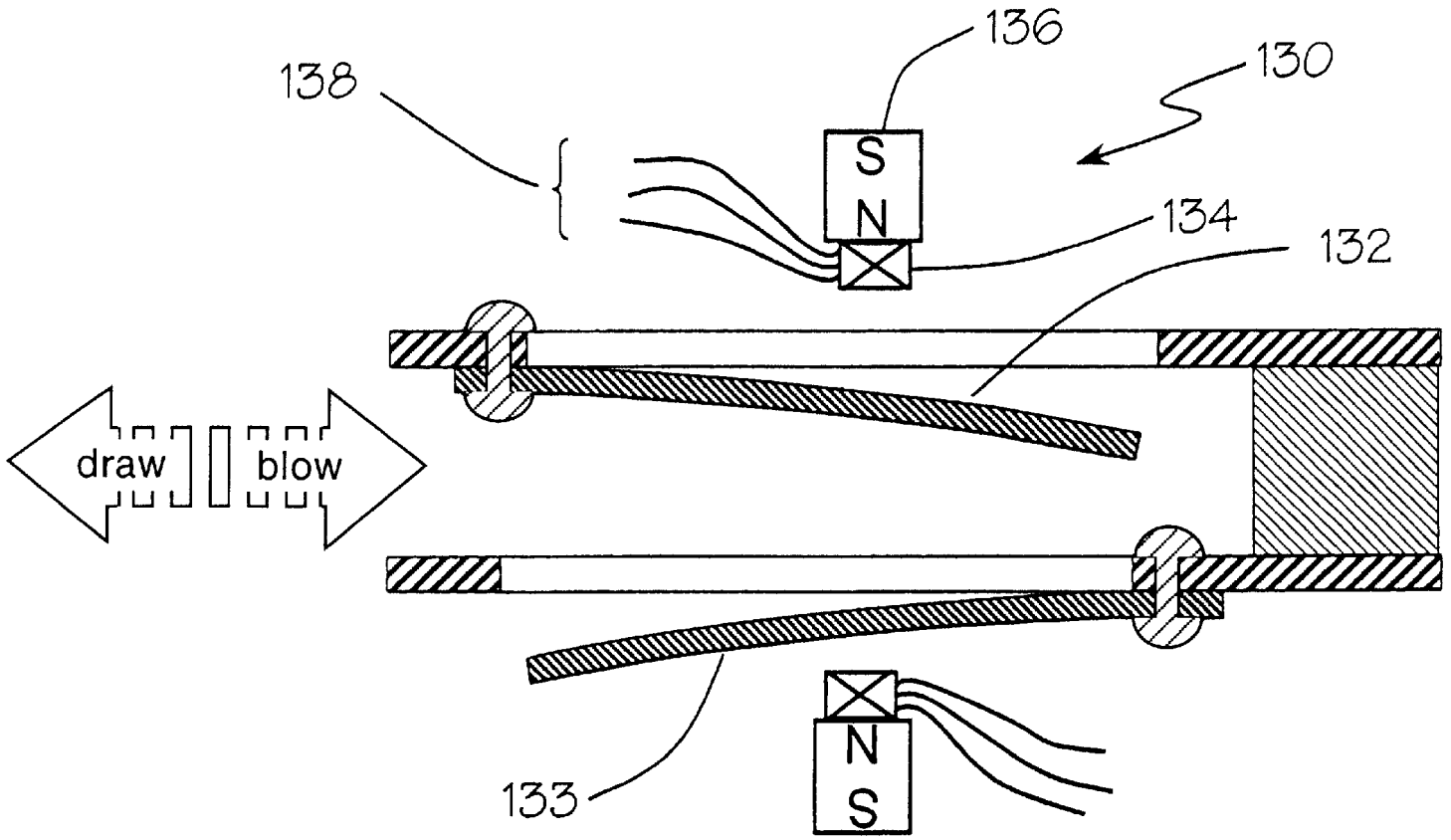
FIG. 10 is a sectional, partially schematic view depicting a Hall effect embodiment of the present invention.

Referring now to FIG. 10, in another aspect of the present invention, a Hall effect sensor 134 can be used in conjunction with a sensor board in a harmonica. The upper reed 132 is preferably ferromagnetic and the sensor 134, which can be one marketed and sold under the trade designation "Allegro 3515" is preferably a linear Hall-effect sensor that is positioned generally adjacent to a magnet 136. When the ferromagnetic reed 132 vibrates, the sensor 134 detects the vibration and converts it into an electrical signal which is transmitted by electrical conductors or leads 138 to auxiliary sound conditioning equipment, for example. It can be understood without further explanation that a similarly operative Hall-effect sensor can also be employed in connection with the lower reed 133.

These foregoing sensor embodiments of the present invention afford flexibility to the harmonica musician by incorporating individual musical audio effects from a combination of reed signals into harmonica play. These embodiments also provide flexibility in mixing the reed signals with additional audio effects.

It can be understood that the present invention also addresses the problem of feedback that can adversely affect harmonica musicians who use amplified equipment. In the course of regular harmonica play, the musician uses a microphone, for example, either placed on a supporting stand or held in the musician's hands, to convert the acoustical energy produced by the harmonica into electrical signals. Feedback results when part of the amplified acoustical energy emanating from the speaker re-enters the microphone, thus resulting in a positive-reinforcing oscillation, which may generate a displeasing audio experience for an audience. In the present invention, the sensors previously described that are located within the harmonica instrument do not rely on acoustical pressure. Hence, the tendency of acoustical energy generated from an amplified speaker to cause undesired feedback between the amplified speaker and the sensors in the harmonica is dramatically reduced.

Figure 11:
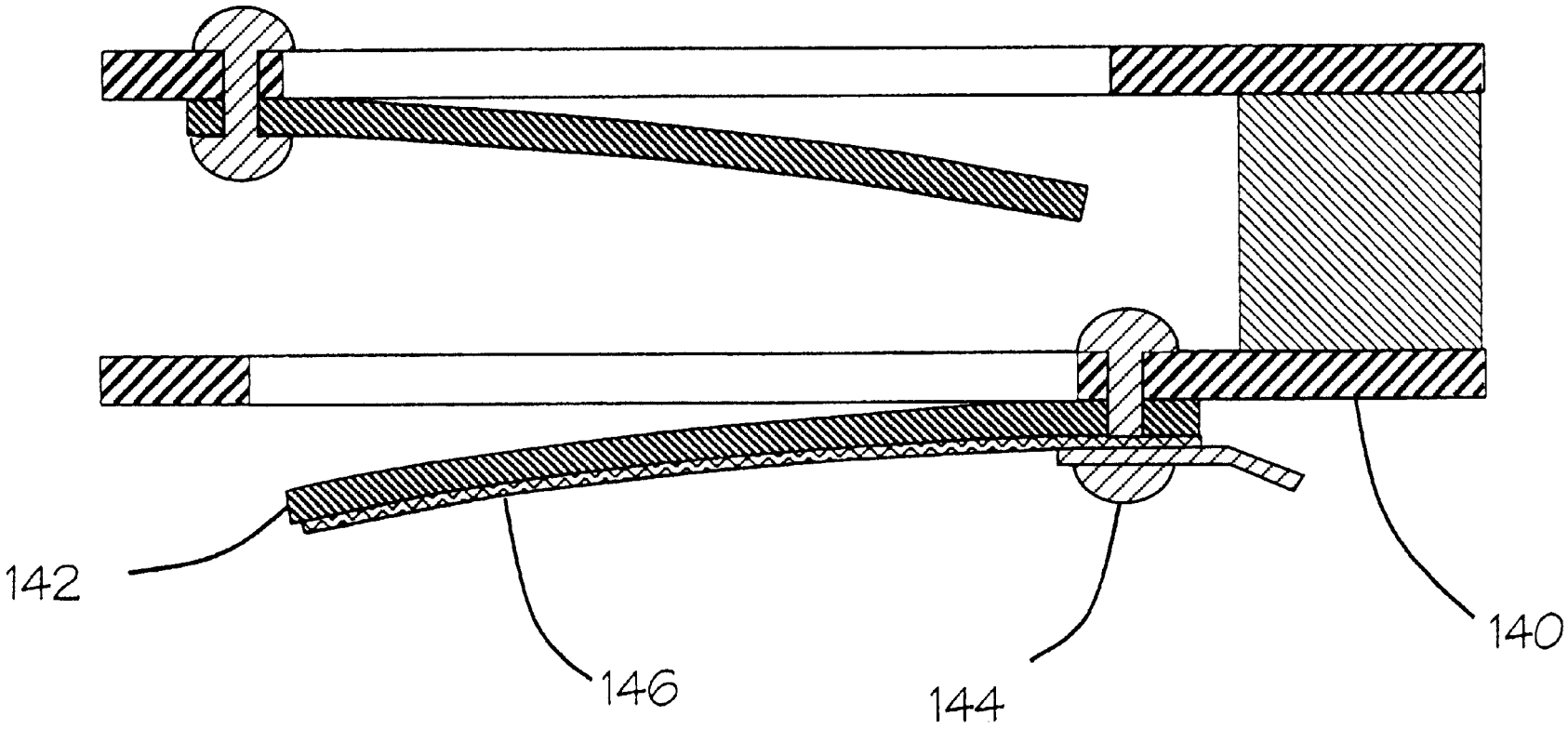
FIG. 11 is a sectional, partially schematic view depicting a piezoelectric embodiment of the present invention.
Figure 12:
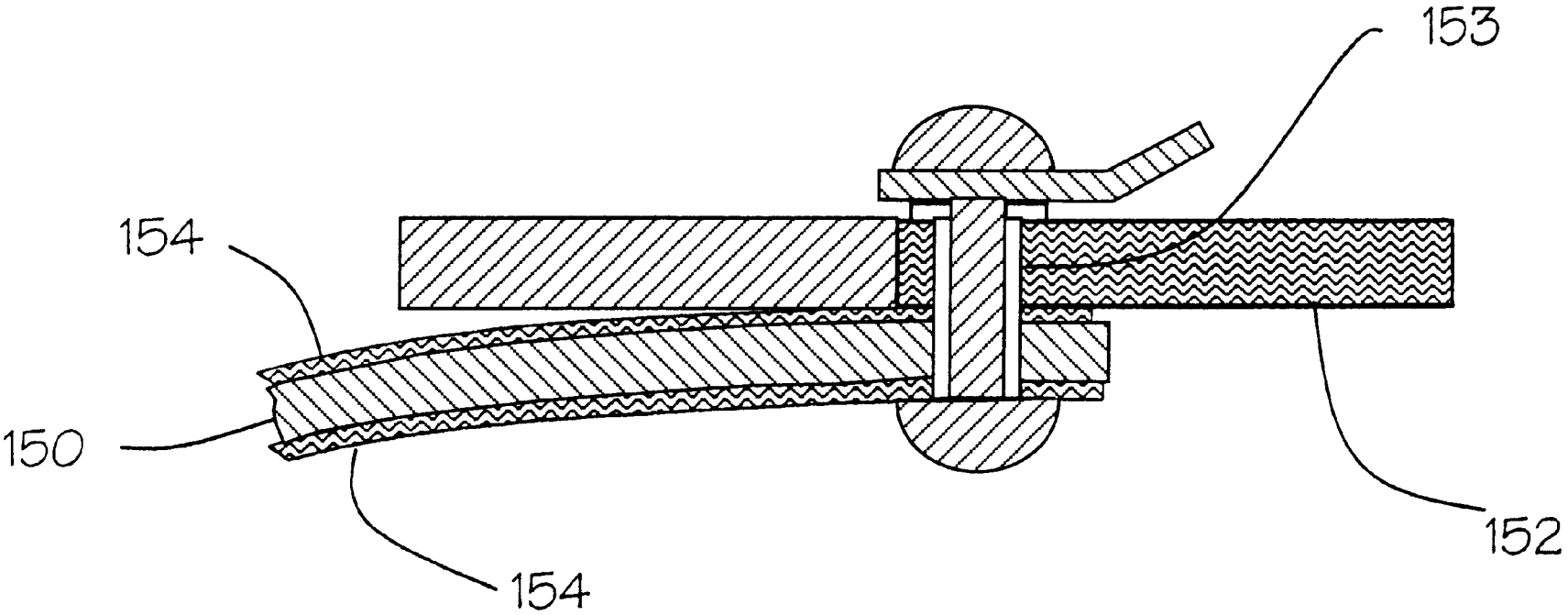
FIG. 12 is a sectional, partially schematic view depicting a piezoelectric embodiment of the present invention.

Referring now to FIGS. 11 and 12, examples of piezoelectric embodiments of the present invention are shown. FIG. 11 shows a draw reed plate 140 with a draw reed 142 connected thereto such as by nylon rivet 144 or another suitable mechanical fastener. As shown, the draw reed 142 has a layer 146 of piezoelectric material disposed thereon. Likewise, FIG. 12 shows a blow reed 150 attached to a blow reed plate 152 having a layer of piezoelectric material 154 disposed thereon. In addition, the piezoelectric material employed herein can be attached to at least one surface of a reed or a plurality of reeds to vary the electrical signal received, converted and transmitted from the mechanical motion of the reed during harmonica play. Also, for a given matched set of reeds, the piezoelectric material can be disposed on one more surfaces of the reeds including both the upper and lower surfaces of the reeds. An insulator 153 can be employed in this arrangement that is composed of a suitable electrically insulating material such as rubber or another like material.

Referring again to FIGS. 11 and 12, the piezoelectric material is selected from the group consisting of lead zirconate titanate (PZT), polyvinylidine difluoride (PVDF), barium titanate, and synthetic quartz ($SiO_2$). The piezoelectric material is applied to the reed by adhesive bonding, vapor deposition or another suitable, conventional means for applying piezoelectric materials to reeds as shown. The thickness of the piezoelectric material is preferably about 0.001 to 0.01 inches, more preferably about 0.001 to 0.005 inches, and most preferably about 0.001 to 0.002 inches. The reeds of the present invention are preferably composed of a ferromagnetic material, such as nickel iron or ferromagnetic stainless steel.

EXAMPLES

The following examples are presented for illustrative purposes only and are not intended to limit the scope of the present invention.

Figure 13:
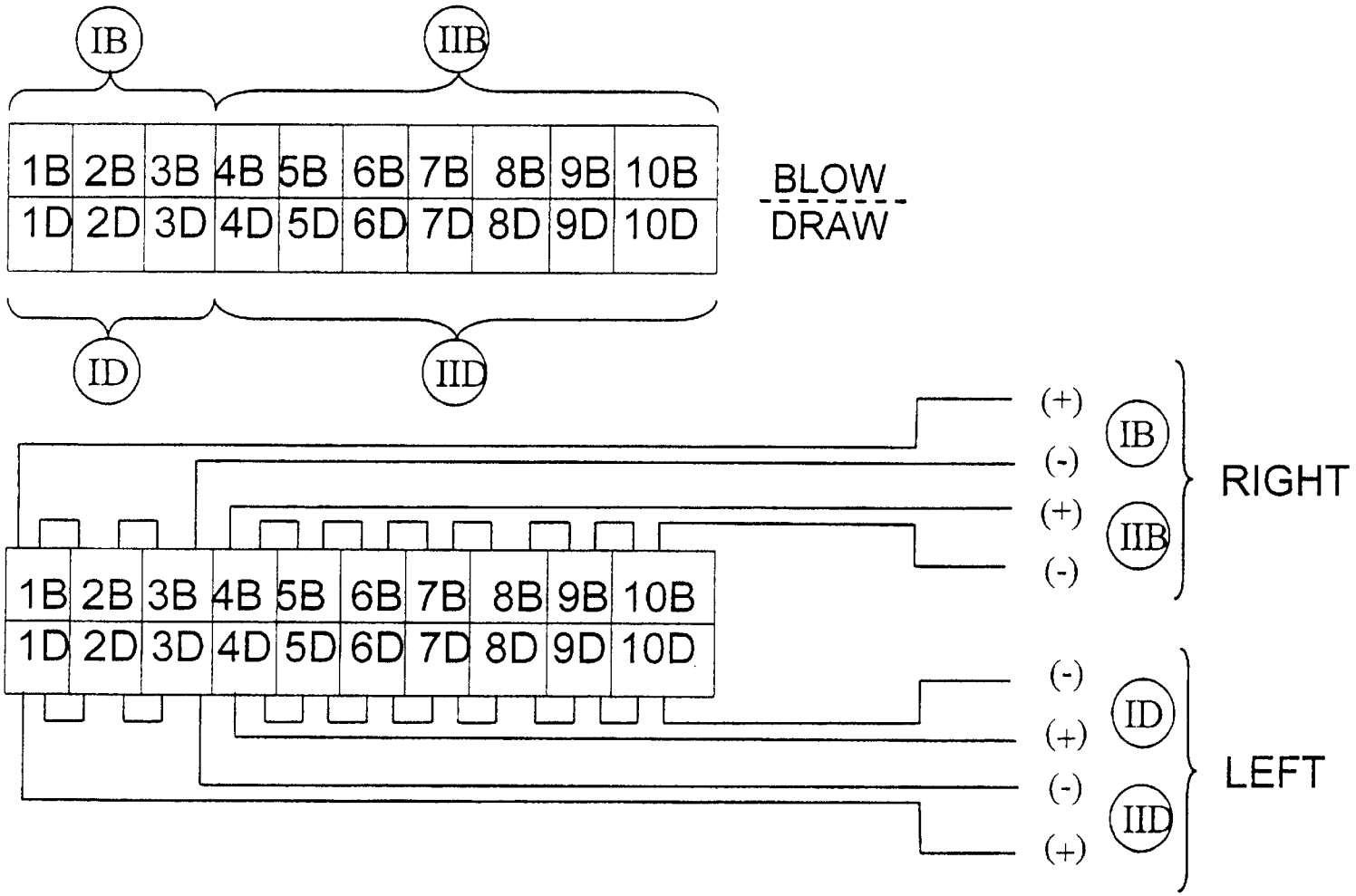
FIG. 13 is a schematic showing an example of capacitive sensor connections in an embodiment of the present invention.

Referring now to FIGS. 13 and 14 and Table A below, the connection of sensors can be arranged in a variety of configurations for the improved harmonica of the present invention. The preferred embodiment employs a configuration that can be designated as "Bass/Treble D/B". The alphanumeric symbols shown in Table A indicate the reed by its corresponding hole number (1–10) in the harmonica and also indicate whether the reed operates by drawing air from the hole ("D") or by blowing air through the hole ("B").

TABLE A

Listing of Configurations and Reed Clusters

| Configuration | Reed Clusters |
|---|---|
| Bass/Treble | (1B, 1D, 2B, 2D, 3B, 3D); (4B, 4D, 5B, 5D, 6B, 6D, 7B, 7D, 8B, 8D, 9B, 9D, 10B,10D) |
| Bass/Treble D/B | (1B, 2B, 3B); (1D, 2D, 3D); (4B, 5B, 6B, 7B, 8B, 9B, 10B); (4D, 5D, 6D, 7D, 8D, 9D, 10D) |
| 3 Octave | (1B, 1D, 2B, 2D, 3B, 3D); (4B, 4D, 5B, 5D, 6B, 6D, 7B, 7D); (8B, 8D, 9B, 9D, 10B, 10D) |
| 3 Octave D/B | (1B, 2B, 3B); (1D, 2D, 3D); (4B, 5B, 6B, 7B); (4D, 5D, 6D, 7D); (8B, 9B, 10B); (8D, 9D, 10D) |
| 20 CHANNEL | Each reed wired to an individual channel. |

Referring again to FIGS. 13 and 14 and Table A, the reed clusters can be mixed or amplified in various conventional ways. For example, with respect to the "Bass/Treble D/B" configuration, the blow reeds and the draw reeds can be respectively directed to the left and right channels of a stereo amplification system. In this embodiment, to the "Bass/Treble D/B" comprises four clusters that can be connected to a stereo system by either of two methods. As shown in FIGS. 13 and 14, for convenience of illustration, the four clusters are grouped and indicated by the designations "IB", "IIB", "ID" and "IID".

The user can connect both blow clusters IB, IIB to a first or right channel of a stereo system and then connect both draw clusters ID, IID to a second or left channel of the stereo system. This connection method is referred to as the Blow/Draw method for the "Bass/Treble D/B" configuration. In addition, the user can connect both of the low octave clusters IB, ID to the first channel of the stereo system and both high octave clusters IIB, IID to another channel of the stereo system. This connection method is referred to as the Bass/Treble method for the "Bass/Treble D/B" configuration.

Referring again to FIG. 14, the electrical interconnection of any pair or group of clusters can be achieved by any suitable, conventional means. One method of interconnection is connecting a pair of clusters in series as shown in FIG. 14A. The series voltages generated by the sensors corresponding to each cluster are summed to obtain and transmit a composite signal. The series arrangement provides the substantial advantage of maximizing the signal to noise ratio for the circuit.

Alternatively, a series/parallel circuit as shown in FIG. 14B can be provided in a standard voltage summer configuration known to those skilled in the art. This voltage summer configuration reduces the number of wires required to connect the circuit. This reduction in the number of required wires is especially beneficial if employed in conjunction with a switch disposed on the harmonica to permit user selection between the previously discussed Blow/Draw and Bass/Treble methods.

In another example, the 20 CHANNEL configuration maximizes flexibility in utilizing electrical signals received from the sensor board during harmonica play. This configuration permits each of the reeds to be individually amplified and processed.

METHOD FOR RETROFITTING A HARMONICA

The present invention also provides a method for retrofitting an existing harmonica. The preferred embodiment of this retrofitting method is used with a 10-hole diatonic harmonica, however it will be appreciated by one skilled in the art that the principles described herein could successfully be applied to a harmonica employing reeds with any suitable number of holes in the harmonica. For example, a sensor board as previously described herein could be incorporated into a specially designed comb that is interchangeable with an existing comb of a conventional harmonica having any number of holes.

Figure 15:
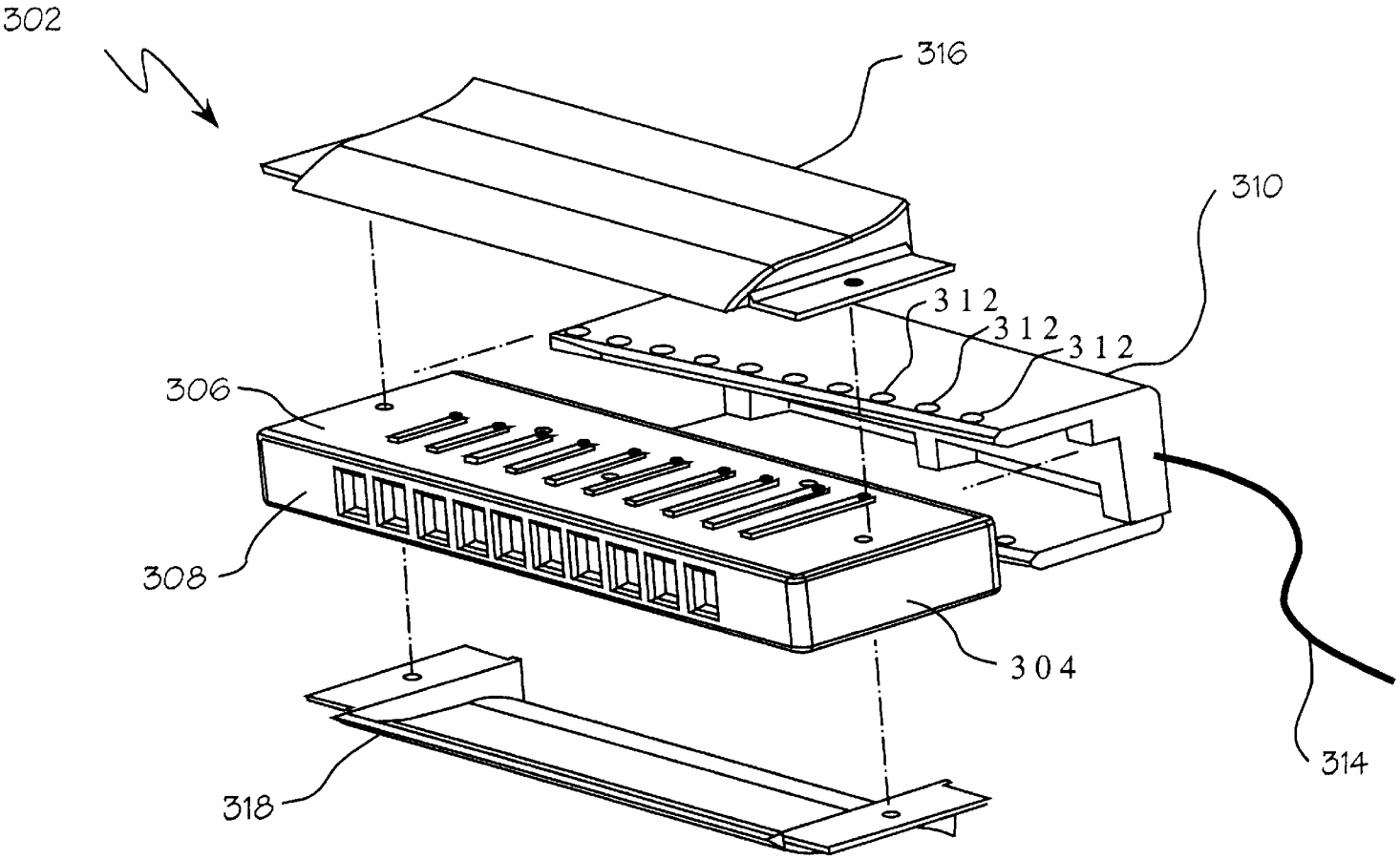

Referring now to FIG. 15, the method for retrofitting of the present invention provides for modifying an existing harmonica 302 having a comb 304 and a set of reed plates 306, 308 each having a plurality of reeds. The method includes inserting the conventional comb 304 into a modified sensor assembly 310 having a transverse slot formed therein suitable for receiving the comb 304 and having a plurality of sensors 312 formed thereon operatively associated with an electrical conductor such as wire 314 for coupling the harmonica 302 to auxiliary sound conditioning equipment as previously discussed. It can be appreciated that the modified sensor assembly 310 can have any suitable configuration and type of sensors operatively associated therewith consistent with previous discussion of aspects of the present invention. For final assembly, cover plates 316, 318 can be used to complete the retrofitting of the harmonica 302.

In another embodiment of the harmonica retrofitting method of the present invention, a harmonica having a comb, a set of reed plates having a plurality of reeds, and a set of cover plates is provided. The method includes removing the cover plates of the harmonica and positioning a first sensor board generally adjacent to a first reed plate and a first cover plate of said harmonica. Then, the method includes positioning a second sensor board generally adjacent to a second reed plate and a second cover plate of said harmonica. As described previously, the two-sensor board retrofitted harmonica can be electrically coupled by its sensor boards to an auxiliary signal conditioning means. In this aspect of the retrofitting method of the present invention, more than one sensor board affords greater flexibility for control and electrical signal manipulation of individual reeds. The advantage of this embodiment is to reduce the need for a specially modified comb. This permits convenient modification of a commercially available harmonica by the attachment of a pair of sensor boards to the harmonica.

It can therefore be appreciated that the present invention substantially expands the capabilities of a harmonica, and allows the harmonica to be used to create new and unique sounds. The present invention involves providing an entirely new and improved harmonica, and also provides a method employed in retrofitting an existing, standard harmonica to improve the existing harmonica and provide the aforementioned benefits of converting reed vibration into a corresponding electrical signal or signals.

Whereas certain terms of relative orientation such as "upper" and "lower" have been used herein to describe the invention, these terms are intended for purposes of illustration only and are not intended to limit the scope of the present invention. In addition, while specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A harmonica having a comb, comprising:

at least one reed plate including a plurality of reeds, at least one of said reeds including means operatively associated with said reed for converting the mechanical vibration of said reed into at least one electrical signal representative of said mechanical reed vibration;

said converting means includes at least one sensor board having at least one sensor positioned thereon; and a comb having a transverse slot formed therein suitably sized to receive said sensor board.

2. The harmonica of claim 1, further including at least one of said sensors positioned on said sensor board to be in substantial alignment with at least one of said plurality of reeds when said sensor board is operatively associated with said reed plate.

3. The harmonica of claim 1, further including means for conducting said electrical signal from said sensor board of said harmonica to an auxiliary electrical signal treatment means.

4. The harmonica of claim 3, wherein said auxiliary electrical signal treatment means is selected from the group consisting of a mixer board, a recording device, a stereo system, an amplifier and a receiver.

5. The harmonica of claim 1, further including transmitting means operatively associated with said reed plate for converting said electrical signal to a radio frequency signal corresponding to said electrical signal.

6. A harmonica comprising:

a pair of reed plates each having a plurality of reeds disposed therein;

a comb positioned between said reed plates having a traverse slot formed therein;

a sensor board disposed in said transverse slot having a plurality of sensors corresponding to said plurality of reeds to detect vibrations of said reeds;

converting means coupled to said sensors for converting said vibrations into electrical signals; and wherein at least one of said sensors is selected from the group consisting of (i) an inductance type sensor; (ii) a cup-core type sensor; (iii) a capacitive sensor; (iv) a Hall effect type sensor; and (v) an optical sensor.

7. The harmonica of claim 6, wherein said converting means is selected from the group consisting of a mixer board, an amplifier, a stereo system, a recording device and a receiver.

8. A harmonica comprising:

a pair of reed plates each having a plurality of reeds disposed therein;

a comb positioned between said reed plates having a traverse slot formed therein;

a sensor board disposed in said transverse slot having a plurality of sensors corresponding to said plurality of reeds to detect vibrations of said reeds;

converting means coupled to said sensors for converting said vibrations into electrical signals; and further comprising at least one capacitor electrically coupled to at least one of said plurality of sensors.

9. A harmonica comprising:

a pair of reed plates each having a plurality of reeds disposed therein;

a comb positioned between said reed plates having a traverse slot formed therein;

a sensor board disposed in said transverse slot having a plurality of sensors corresponding to said plurality of reeds to detect vibrations of said reeds;

converting means coupled to said sensors for converting said vibrations into electrical signals; and wherein there is a one-to-one correspondence between said sensors and said reeds.

10. A harmonica comprising:

a pair of reed plates each having a plurality of reeds disposed therein;

a comb positioned between said reed plates having a traverse slot formed therein;

a sensor board disposed in said transverse slot having a plurality of sensors corresponding to said plurality of reeds to detect vibrations of said reeds;

converting means coupled to said sensors for converting said vibrations into electrical signals; and wherein there is one-to-two correspondence between said sensors and said reeds such that at least one of said sensors receives and converts mechanical vibrations received from only one matching pair of said reeds.

11. A harmonica comprising:

a pair of reed plates each having a plurality of reeds disposed therein;

a comb positioned between said reed plates having a traverse slot formed therein;

a sensor board disposed in said transverse slot having a plurality of sensors corresponding to said plurality of reeds to detect vibrations of said reeds;

converting means coupled to said sensors for converting said vibrations into electrical signals; and at least one of said reeds has a layer of piezoelectric material disposed on a surface thereof, whereby said piezoelectric material alters said vibrations produced from said reed.

12. The harmonica of claim 11, further including said plurality of reeds each having a layer of piezoelectric material disposed thereon.

13. The harmonica of claim 11, wherein said piezoelectric material is a material selected from the group consisting of lead zirconate titanate, polyvinylidine difluoride, barium titanate, and synthetic quartz.

14. A harmonica having first and second reed plates and first and second cover plates comprising, a first sensor board positioned between a first reed plate and a first cover plate of said harmonica; and, a second sensor board positioned between a second reed plate and a second cover plate of said harmonica.

15. A method for retrofitting a harmonica having a comb, a set of reed plates having a plurality of reeds, and a set of cover plates, comprising:

removing said cover plates of said harmonica;

positioning a first sensor board generally adjacent to a first reed plate and a first cover plate of said harmonica;

positioning a second sensor board generally adjacent to a second reed plate and a second cover plate of said harmonica; and, reassembling said harmonica.

* * * * *

UNITED STATES PATENT AND TRADEMARK OFFICE

CERTIFICATE OF CORRECTION

PATENT NO. : 6,326,532 B1
DATED : December 4, 2001
INVENTOR(S) : James F. Antaki It is certified that error appears in the above-identified patent and that said Letters Patent is hereby corrected as shown below:

Title page,
Item [56], References Cited, U.S. PATENT DOCUMENTS, first line date should read -- 2/1943 --; second line date should read -- 5/1947 --; and third line date should read -- 7/1948 --.

Drawings,
Sheet 13 of 14, delete "Fig 14" at the bottom of page.

Column 6,
Line 39, "rite" should read -- ferrite --.

Signed and Sealed this

Third Day of June, 2003

JAMES E. ROGAN
*Director of the United States Patent and Trademark Office*